United States Patent [19]

Hensley

[11] 4,257,189

[45] * Mar. 24, 1981

[54] TOY HOOP GUIDE ROD

[76] Inventor: Richard K. Hensley, P.O. Box 151, Hazel Park, Mich. 48030

[ * ] Notice: The portion of the term of this patent subsequent to Nov. 13, 1996, has been disclaimed.

[21] Appl. No.: 49,523

[22] Filed: Jun. 18, 1979

Related U.S. Application Data

[62] Division of Ser. No. 885,508, Mar. 13, 1978, Pat. No. 4,173,841.

[51] Int. Cl.[3] ..... A63H 33/26

[52] U.S. Cl. ..... 46/241; 46/220

[58] Field of Search ..... 46/220, 29, 236, 238, 46/239, 241

[56] References Cited

U.S. PATENT DOCUMENTS

| | | | |
|---|---|---|---|
| 1,005,853 | 10/1911 | Lewis | 46/236 |
| 1,446,868 | 2/1923 | Baker | 46/29 |
| 2,984,937 | 5/1961 | Rendon | 46/220 |
| 3,099,105 | 7/1963 | Martinez | 46/241 |
| 4,173,841 | 11/1979 | Hensley | 46/220 |

FOREIGN PATENT DOCUMENTS

| | | | |
|---|---|---|---|
| 744913 | 10/1966 | Canada | 46/220 |

*Primary Examiner*—Gene Mancene
*Assistant Examiner*—Mickey Yu
*Attorney, Agent, or Firm*—Cullen, Sloman, Cantor, Grauer, Scott & Rutherford

[57] ABSTRACT

A guide rod, for rolling a toy hoop, formed of a squared U-shaped guide portion with a short shaft portion arranged approximately perpendicular to the plane of said guide portion and integral with the free end of one of the legs of the guide portion. An elongated pole-like handle is releasably connected to the end of the shaft. The guide portion is made in interchangeable left and right hand configurations, by arranging the U-shape on its side, to open sideways, with the shaft formed on the free end of the upper leg, and with the shaft extending approximately perpendicularly away from the plane of the U-shape in either one or the opposite direction to form either a left or right handed guide, either of which may be interchangeably used with the same handle. The U-shaped guide portion further includes a magnet embedded therein for magnetically attracting a magnetically responsive hoop.

1 Claim, 15 Drawing Figures

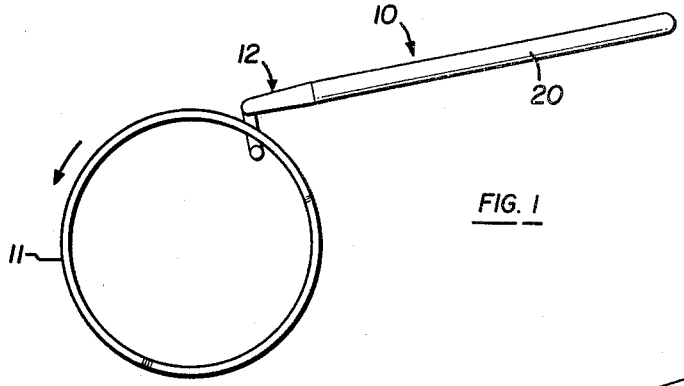
FIG. 1
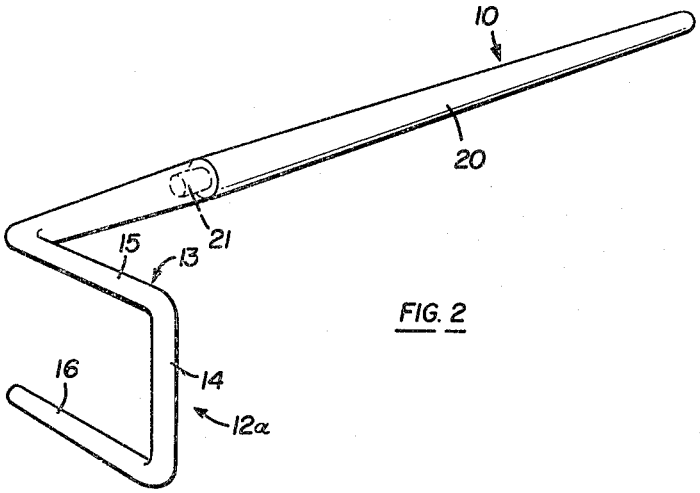
FIG. 2
FIG. 3
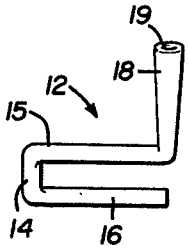
FIG. 4
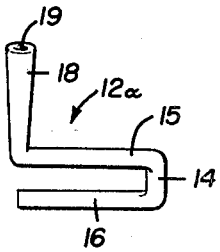
FIG. 5
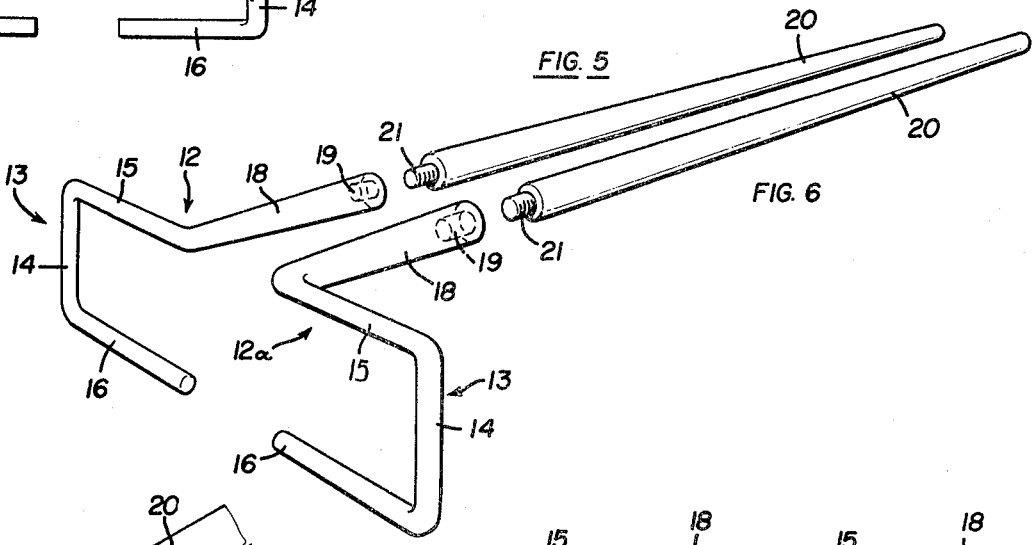
FIG. 6
FIG. 7
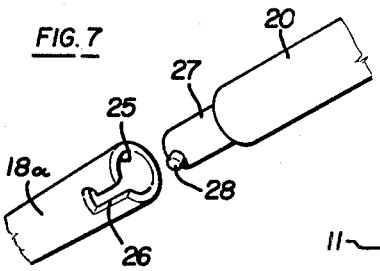
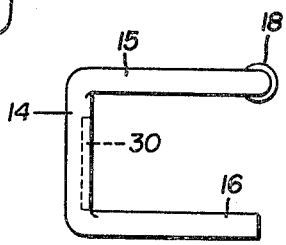
FIG. 8
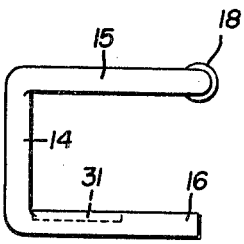
FIG. 9
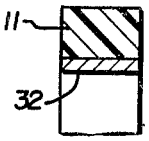
FIG. 10

TOY HOOP GUIDE ROD

This application is a division of my earlier application Ser. No. 885,508, filed Mar. 13, 1978, now U.S. Pat. No. 4,173,841.

BACKGROUND OF INVENTION

The invention herein relates to a toy rolling hoop which is guided and propelled by means of a long rod provided with a U-shaped end portion for engaging the hoop. Examples of hoops and guide rods of the general type involved are illustrated in U.S. Pat. No. 2,984,937 issued May 23, 1961 to Rendon, U.S. Pat. No. 3,535,820 issued Oct. 27, 1970 to Thompson, U.S. Pat. No. 3,731,425 issued May 8, 1973 to Streeter and U.S. Pat. No. 3,956,851 issued May 18, 1976 to Tapinekis.

In the past, the guide rods were typically made for a right handed operation. Use of such a device by a left handed child is generally more difficult and somewhat frustrating. Hence, it would be desirable to provide a push rod device which can be easily used in either a right handed or left handed manner and yet is made very inexpensively since toys of this character are classified in the low price category. Hence, the invention herein is concerned essentially with the provision of a guide rod which may be selectively formed in either a right or left handed manner.

SUMMARY OF INVENTION

The invention herein concerns the provision of a toy hoop guide rod which is formed in two separable parts, namely a guide end portion and a handle portion, with the guide end portion being formed either in a right handed or left handed use configuration, for interchangeable connection to a single handle or rod portion. In essence, the invention herein contemplates forming, as by molding out of plastic, a squared U-shaped guide having an integral short mounting shaft connected with one of the free legs of the U-shape and depending upon which direction the leg extends relative to the plane of the U-shape, the guide forms either a left or a right hand configuration. Since the guides are otherwise identical, they may be selectively used with a single handle which is in the form of a long, pole-like rod which is mechanically coupled to the end of the shaft.

The manufacturer normally would form three parts, namely a left handed guide, a right handed guide, and a single handle and the sellers would normally sell a handle with either or both a left handed or a right handed guide for mechanical coupling together. Hence, a choice of a left handed or right handed guide may be provided with the hoop toy at very low cost.

Various objects and advantages of this invention, in addition to those expressed above, will become apparent upon reading the following description, of which the attached drawings form a part.

DESCRIPTION OF DRAWINGS

FIG. 1 is an elevational view of a top rolling hoop and the guide rod.

FIG. 2 is a perspective view of the guide rod.

FIG. 3 is a perspective view, looking down, almost like a plan view, of a right hand guide member, and FIG. 4 is a view similar to FIG. 3, but showing a left hand guide member.

FIG. 5 is a perspective disassembled view of a right hand guide member and handle.

FIG. 6 is a view similar to FIG. 5, but showing a left hand guide member and its handle.

FIG. 7 illustrates a fragmentary portion of a modification illustrating a bayonet slot type of mechanical coupling between the guide member shaft and the handle.

FIG. 8 is an elevational end view of the guide member showing a modification wherein a magnet is mounted within the base thereof, and FIG. 9 is a further modification, showing a view similar to FIG. 8, but wherein the magnet is mounted within a leg of the guide member.

FIG. 10 illustrates a fragmentary, cross-sectional view of a hoop having a magnetically responsive metal layer applied thereto.

DETAILED DESCRIPTION

Figure 11:
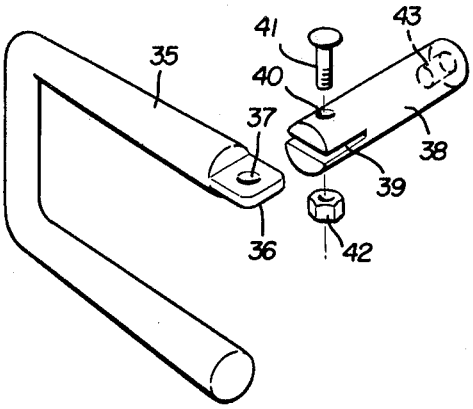
FIG. 11 is a perspective view of a modification, with the parts shown disassembled.

FIG. 1 illustrates a guide rod 10 engaging a toy hoop 11. The hoop is conventional, and may be, for example, of a foot and one half in diameter and made of either hollow tubing joined at its opposite ends into a hoop-form, or of a solid material.

The guide rod is formed of either a right hand guide member 12 (see FIGS. 2, 3 and 5) or a left hand guide member 12*a* (see FIGS. 4 and 6). These guide members are identical with one exception, as will be described below.

The guide members, whether left or right handed, are formed of a squared U-shaped guide portion 13 having a base part 14 with integral legs 15 and 16. A short shaft 18 is formed integral with the end of one leg. The free end of the shaft is provided with a threaded socket 19. The shaft is roughly perpendicular to the plane containing the U-shaped guide portion 14. That is, the shaft may be actually perpendicular or may be angled upwardly relative to a vertical plane. Depending upon which direction the shaft extends relative to the plane of the U-shaped guide portion, a left hand or right guide is formed. For example, FIG. 5 illustrates a right hand guide and FIG. 6 illustrates a left hand guide, both identical, except for the relative positioning between the shafts and the bases 14.

Because of the similarity in construction, except for the direction of extension of the shaft, suitable molds can be made which can be adapted to mold either left or right hand guides depending upon the cavity arrangements for the shaft. Thus, the guides can be inexpensively made out of molded plastic of a suitable commercially available type. Alternatively, the guides could be formed out of heavy, bent wire-like metal, although that is likely to be more expensive.

The handle 20 of the guide rod is formed of an elongated pole-like rod whose length may be varied, but which is considerably longer than the shaft. A threaded extension 21 is formed on one end of the rod for threadedly engaging within the threaded socket 19 on the shaft to thereby releasably couple the handle to the shaft and to the guide member. As can be seen, a single handle 20 can be utilized with either a left hand or right hand guide member, whichever is pre-selected.

In use, the child operator who is rolling a hoop, if right handed, normally would keep the guide in the position shown in FIG. 2, that is, with the base 14 essentially vertical and to the right side of the user. The reverse is the position for the left handed user, i.e., with the base 14 on the left side. An alternative use position could be with the base 14 arranged horizontally at the lower rear quadrant of the hoop, and the leg 15 arranged vertically and on the right side of the right hand configuration or the left side of the left hand configuration. In this manner, the hoop is guided and pushed for rolling motion.

FIG. 7 illustrates a modified form of coupling between the handle 20 and the modified shaft 18*a*. Here, the end socket 25 is provided with a conventional bayonet slot 26 for receiving the handle extension 27 and a protuberance of bump 28 which interlocks with the bayonet slot. Other forms of mechanical interlocking may be utilized for interconnecting the handle to the shaft.

FIGS. 8–10 illustrate modifications which incorporate the use of magnets within the guide member for magnetically interacting with the hoop. Thus, as illustrated in FIG. 8, a relatively weak, permanent magnet 30 is embedded within the base 14 of the guide portion. FIG. 9 shows a magnet 31 embedded within the leg 16 of the guide portion. In either case, the hoop 11 is provided with a layer or lining 32 of a magnetically responsive ferrous material so that the hoop is magnetically attracted to the guide and the two tend to stay together even though the magnetic attraction is not sufficient to interfere with the rolling motion of the hoop relative to the guide. Of course, the entire hoop can be made of metal in any coventional manner. However, FIG. 10 illustrates a construction wherein the hoop is made out of a plastic material which is provided with a metal liner 32 bonded to the plastic.

Figure 12:
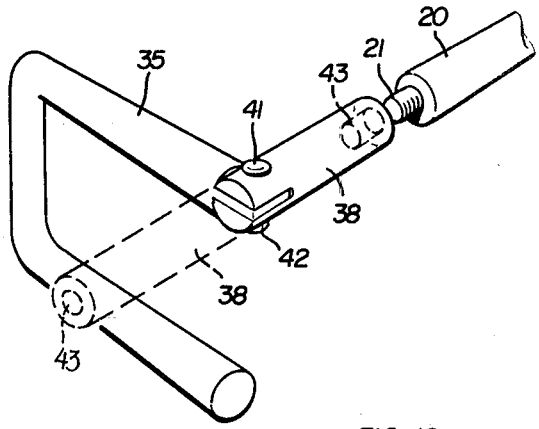
FIG. 12 shows the modification of FIG. 11 with the shaft in one of its two positions.
Figure 13:
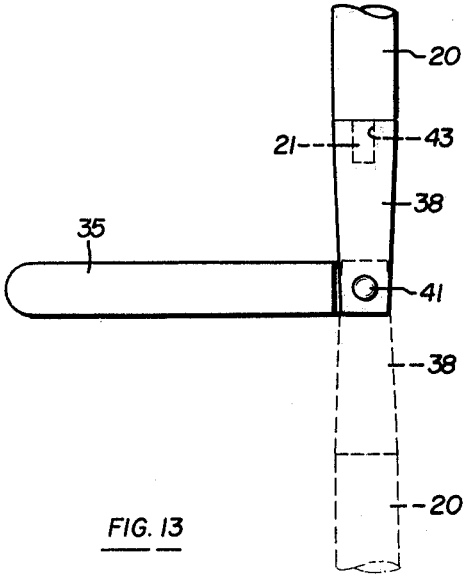
FIG. 13 is a top, plan view of the modification of FIG. 12.

FIGS. 11–13 illustrate another modification wherein the shaft is formed separately from the guide and may be secured in either one of two positions for left or right hand use. Here, the U-shaped guide member 35 is provided with a tongue 36 at the end of one of its legs. An opening 37 extends through the tongue. The shaft 38 is formed with a slot 29 to receive the tongue and an opening 40 for alignment with the opening 37 of the tongue. A mechanical fastener, such as a bolt 41 extends through the aligned openings 40 and 37 and may be locked in place by a suitable nut 42. Thus, the shaft may be secured in a right hand use position as illustrated by the solid lines in FIGS. 12 and 13 or alternatively, it may be swung around into a left hand use position as illustrated by the dotted lines.

The free end of the shaft is provided with a threaded opening 43 to receive the threaded extension 21 of the handle 20.

Figure 14:
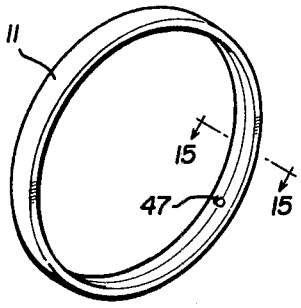
FIG. 14 is a perspective view of a hoop.
Figure 15:
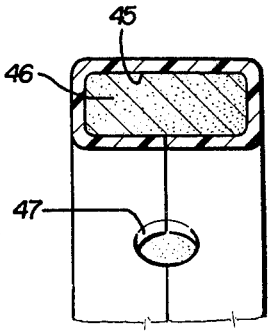
FIG. 15 is an enlarged, cross-sectional view of a fragment of the hoop taken in the direction of arrows 15—15 of FIG. 14.

FIG. 14 illustrates the hoop 11 in perspective. This hoop may be made hollow, such as is illustrated in FIG. 15. That is, the hoop may be made of a sheet material which is bent around to provide a hollow interior 45. This interior may be filled with sand 46 or the like particulate material to give the hoop additional weight. In order to fill the interior of the hoop, at least one opening 47 is provided and a suitable cap or filler or even putty may be used to plug up the hole after filling.

With this construction, the hoop may be handled and shipped empty to save weight and then may be filled later before sale or after sale, whichever is more desirable.

Having fully described an operative embodiment of this invention, I now claim:

1. A guide rod for rolling and guiding a toy hoop, comprising:

a guide member and a separate handle member;

said guide member being formed of a squared U-shaped guide portion having a base with integral legs, with a relatively short shaft having one end joined to the free end of one of the legs, so that the shaft extends outwardly of the plane of the guide portion;

said handle member being formed of an elongated rod arranged in alignment with said shaft;

and mechanical fastening means coupling the rod to the free end of the shaft including the rod end being joined to the shaft end by means of a socket formed in one end and an extension formed on the other end for fitting within said socket and releasably interconnecting the rod and shaft co-axially;

a relatively weak magnet embedded within said U-shaped guide portion for magnetically attracting a hoop having a magnetically responsive metal liner extending along its circumference, whereby the hoop may roll relative to the magnet while tending to remain within the U-shaped guide portion;

and said guide member being formed for either left hand or right hand use by pre-forming the shaft to extend roughly perpendicularly to, but in either one direction or in an opposite direction, relative to the plane of the guide portion;

whereby a left handed or right handed guide member can be selectively coupled to the same rod for pre-selected right hand or left hand use.

* * * * *